US005827592A

United States Patent [19]

Van Gulik et al.

[11] Patent Number: 5,827,592

[45] Date of Patent: Oct. 27, 1998

[54] FLOOR ELEMENT

[75] Inventors: Menno Van Gulik, Heuvelstraat 2, P.O. Box 6, Lanaken, Belgium; Robert Bartholomeus Mentzen, Theodor Schaepmakersstraat 4, NL-6221 VZ Maastricht, Netherlands; Jozef Hendrik Catharina Maria Gerardus Eymael, Maastricht, Netherlands

[73] Assignees: Menno Van Gulik, Lanaken, Belgium; Robert Bartholomeus Mentzen, Maastricht, Netherlands

[21] Appl. No.: 602,747

[22] PCT Filed: Aug. 24, 1994

[86] PCT No.: PCT/NL94/00201

§ 371 Date: Apr. 18, 1996

§ 102(e) Date: Apr. 18, 1996

[87] PCT Pub. No.: WO95/06176

PCT Pub. Date: Mar. 2, 1995

[30] Foreign Application Priority Data

Aug. 24, 1993 [NL] Netherlands ..... 9301469

[51] Int. Cl.[6] ..... B32B 3/10

[52] U.S. Cl. ..... 428/44; 428/45; 428/46; 428/50; 428/52; 428/76; 428/192; 428/537.1

[58] Field of Search ..... 428/44, 45, 46, 428/50, 52, 68, 76, 192, 537.1; 52/385, 386; 144/327

[56] References Cited

U.S. PATENT DOCUMENTS

| | | | |
|---|---|---|---|
| 3,894,569 | 7/1975 | Huttunen | 144/327 |
| 3,907,624 | 9/1975 | Gravely | 156/214 |
| 5,156,569 | 10/1992 | Muller | 454/297 |

FOREIGN PATENT DOCUMENTS

| | | |
|---|---|---|
| 2 591 641 | 6/1987 | France . |
| 31 17 605 | 11/1982 | Germany . |
| 32 43 623 | 5/1984 | Germany . |
| 9000342 | 9/1991 | Netherlands . |

*Primary Examiner*—Nasser Ahmad
*Attorney, Agent, or Firm*—Young & Thompson

[57] ABSTRACT

A floor element for covering a base in which the bearing surface consists of a wood fibre board which is covered with a transparent lacquer coating at least on the bearing surface. This floor element can be laid together with other such floor elements on a flat base to form a floor, by joining the elements together by the side edges. The floor element is very durable due to the fact that it undergoes less delamination under the effects of moisture and is more scratch-resistant and hard-wearing. Furthermore, the floor element has a very attractive, natural-looking appearance.

3 Claims, 1 Drawing Sheet

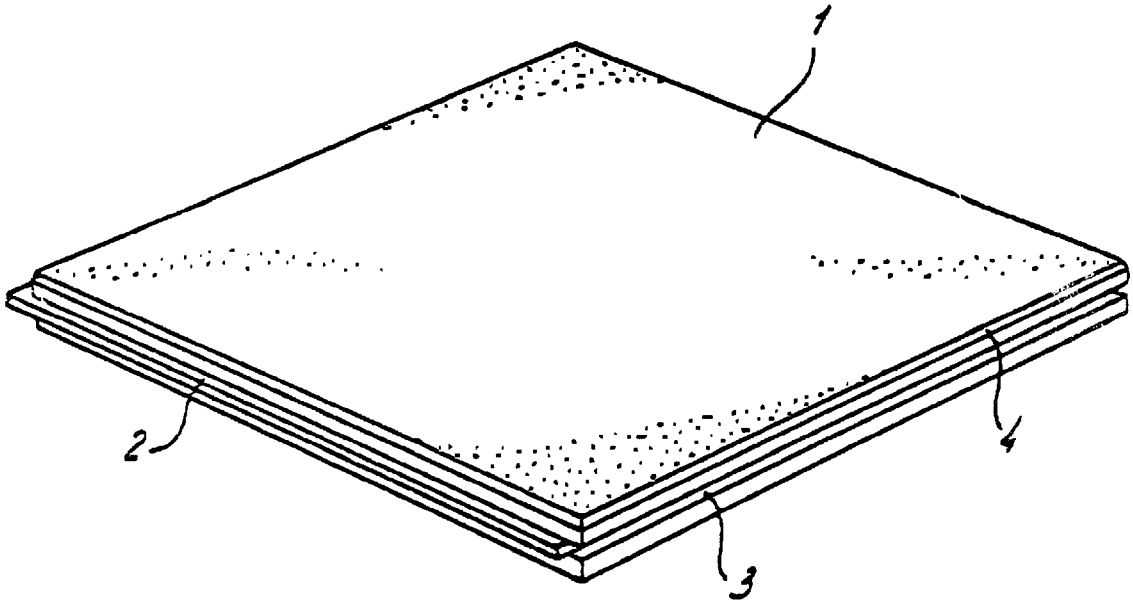
1
2
3
4

FLOOR ELEMENT

FIELD OF THE INVENTION

The invention relates to a floor element for covering a substrate, which floor element comprises a wood fibre board. This floor element can be laid together with other such floor elements on a flat substrate to form a floor, by joining the elements together by the side edges.

BACKGROUND OF THE INVENTION

Such a floor element is known from Dutch Patent Application NL-A-9000342. This known floor element comprises a carrier board, consisting of two wood fibre boards, and a hard, hard-wearing and scratch-resistant plastic sheet thereon as the bearing surface. Bearing surface in this case should be understood as the surface of the floor element facing away from the substrate. The carrier board and plastic sheet are bonded together with adhesive. The floor elements can be joined together to form a floor by providing them at the side edges with tongues and grooves which fit into each other. A floor made up of such floor elements, consisting of a carrier board and a plastic sheet, is known as a laminated parquet floor.

A disadvantage of the known floor element is that when it is exposed to fluctuating temperature and air humidity, and in particular when it is in direct contact with moisture, the floor element can become warped, and the plastic sheet can become detached from the fibre board (delamination). As a result of this, bulges occur relatively quickly at the side edges of the floor element in particular, which means that in use uneven wear of the plastic layer occurs, which therefore means that the appearance of the floor becomes unattractive. Owing to these effects, the service life of a floor made from the known floor elements is often undesirably limited. In practice, in order to lessen this disadvantage, people are therefore generally advised that when laying the floor elements to form a floor they should apply an adhesive between the tongues and the grooves of the adjacent floor elements. The disadvantage of this is that the floor elements cannot be removed again without damaging them, for example when moving house. Another major disadvantage of the known floor elements is that a plastic sheet is artificial, i.e. unnatural, in appearance.

From FR-A 2 591 641 a floor element is known comprising a support on which a wooden fibre material is provided. The top of the wooden fibre material is covered with a lacquer layer.

From DE-A-3 243 623 a fibre mat is known which can be shaped by pressing and is hardened with a resin material.

The fibres of both the German and the French specification are relatively non-dense and unsuitable to be used as floor element without any support.

SUMMARY OF THE INVENTION

The object of the invention is to provide floor elements in which the abovementioned disadvantages are less apparent.

This object is achieved according to the invention through the fact that the floor element has a bearing surface consisting of a wood fibre board which is covered with a transparent lacquer coating at least on said bearing surface.

It has been found that the floor element according to the invention can readily withstand exposure to fluctuating air humidity and temperature. It has also, surprisingly, been found that the floor element according to the invention very satisfactorily meets the high standards which are set for floors in practice without the use of a hard plastic sheet. This is particularly surprising because wood fibre boards per se have been known for a long time now and have already been in use for a fairly long time as carrier boards in floor elements. A possible explanation for the good properties of the floor element may be that, when applied to the wood fibre board of the bearing surface, the transparent lacquer, through its absorbent action, does not simply lie on the wood fibre board, but can also penetrate there to a certain depth into the board. A reinforcement of the top layer of the wood fibre board and very good adhesion of the lacquer coating to the wood fibre board are obtained as a result.

Due to the fact that the fibre structure of the wood fibre board remains visible through the transparent lacquer coating, the floor element according to the invention has a very attractive natural appearance which to some extent resembles natural stone. Another major advantage of the invention is that the floor element is simpler to manufacture and consequently also economically more attractive.

The floor element is preferably made entirely of wood fibre material. In this case it is possible, for example, to bond together two or more wood fibre boards, as the carrier board, and one wood fibre board, as the bearing surface, in which case tongues and grooves are formed at the side edges of the floor element through the fact that at least two essentially identically shaped wood fibre boards are lying staggered relative to each other. The wood fibre boards in the carrier board and that of the bearing surface can be different. For example, the wood fibre boards in the carrier board can be of a lower density and hardness than the wood fibre board of the bearing surface. In the most preferred embodiment the floor element consists of a single wood fibre board which at the side edges is provided with milled-in tongue and groove, and which is covered with a lacquer coating at least on its top side. The advantage of this embodiment is that the risk of delamination is reduced even further through the fact that the floor element is of an essentially homogeneous structure. A further advantage of this embodiment is that it is simpler to manufacture.

The wood fibre board is covered wish a transparent lacquer coating at least on the bearing surface. The transparent lacquer coating used can in principle be any type of transparent lacquer suitable for floors which is scratch-resistant and hard-wearing, and which is water-repellent and dirt-repellent. Such lacquers are known to the person skilled in the art. It has been found that good results can be achieved with the use of a lacquer which for hardening purposes has a relatively low viscosity when applied to the wood fibre board. A powder coating can also be applied, instead of lacquers. Such a coating can be applied in one layer in an environmentally friendly and efficient way, and produces a particularly hard-wearing coating. The attractive natural appearance of the floor element is obtained through use of the transparent lacquer coating in conjunction with the fibrous appearance of the wood fibre board. It has also been found that a transparent lacquer coating in conjunction with a wood fibre board is much more suitable for use in a floor element than a masking lacquer coating. The bearing surface of the floor element according to the invention can be coloured with a pigment. A major advantage of the floor element according to the invention relates to coloured floor elements. Owing to the relatively great absorbency of the wood fibre board of the bearing surface, when a pigment-containing liquid is applied thereto, said surface is impregnated and thus coloured over a relatively great penetration depth. This reduces the risk of the uncoloured base becoming visible through wear of or damage to the lacquer coating.

Any damage to the lacquer coating and bearing surface can be repaired virtually invisible, i.e. it can be repaired without colour difference by applying a new transparent lacquer coating. The damaged place can even be lightly sanded down in this case without the uncoloured base becoming visible. The wood fibre board of the bearing surface can be coloured by treating the surface thereof first with, for example, a stain (for example. nitrocellulose stain) and then applying an uncoloured, transparent lacquer coating. The advantage of the method is that the wood fibre board is coloured to a fairly great penetration depth, The wood fibre board of the bearing surface can also be coloured in a single treatment by using a coloured, transparent lacquer coating. It is most preferable to use a wood fibre board which is already coloured completely through and through with a pigment.

The lacquer coating covers the wood fibre board of the bearing surface at least over the surface area of said bearing surface. Sufficient protection against wear is obtained in this ways. Since in practice it is very difficult to join together the floor elements to form a floor with such accuracy that no open seams occur between the floor elements, the tongues and grooves at the side edges of the floor element are also preferably provided with a lacquer coating. This minimizes the sensitivity to the action of moisture after joining together of the floor elements to form a floor, even if the floor is brought into direct contact with water. It is most preferable for the floor element to be provided with a lacquer coating on all sides. In this way it is possible to use both sides of the tile, in other words the tile can be turned over when it is worn or damaged.

A wood fibre beard of relatively high density is preferably used for the bearing surface in the floor element according to the invention. The density of the wood fibre board is preferably at least 700 kg/m$^3$. Such boards have better mechanical properties, such as, for example, hardness and strength, than boards of lower density, such as chipboard (density 400–500 kg/m$^3$). It is more preferable for the density to be at least 800 kg/m$^3$, and most preferable for it to be at least 900 kg/m$^3$. Good results can be achieved if the wood fibre board has a hardness of at least 4000 N. A high hardness means better resistance to the high pressure loads often occurring in practice (for example. from stiletto heels). The hardness is determined according to Janka. It is more preferable for the Janka hardness to be higher than 5000 N. and most preferable for it to be higher than 6000 N. Suitable types of wood fibre board are known under the name of medium-density fibre board (MDF) or high-density fibre board (HDF). Special water-resistant MDF boards are particularly suitable.

BRIEF DESCRIPTION OF THE DRAWINGS

An example of a tile according to the invention is shown in the drawing.

DETAILED DESCRIPTION OF THE INVENTION

The title depicted in the drawing consists of a rectangular piece of MDF with a density of 800 kg/m$^3$. This tile is indicated in its entirety by 1. It is provided with a groove 2 and a tongue 3, in order to allow it to be joined to adjacent tiles.

As an example of the dimensions of the tile, a length and breadth of 59 cm can be mentioned, while the thickness can be approximately 9–10 m.

Near the top side, the tile is provided with a bevel 4. If the tile 1 is also provided with a bevel at the bottom side, both sides of it can be used.

The tile shown here is covered on both sides with a powder coating.

Although the invention is described above with reference to a preferred embodiment, it must be understood that numerous modifications can be made thereto. For example, the tile can be of different dimensions and in other shapes.

These and further variants are considered to lie within the scope of the appended claims.

We claim:

1. In a floor element for covering a base, the floor element comprised entirely of one or more wood fibre boards, each of said boards being provided with milled-in tongues and grooves at the side edges, and being completely covered at its front and rear sides with an at least partially transparent lacquer coating, the improvement wherein all the side edges of said floor element are also completely covered with an at least partially transparent lacquer coating, said fibre board having a density of at least 700 kg/m$^3$ and a hardness (according to Janka) of at least 4000 N.

2. Floor element according to claim 1, wherein the wood fibre board has a density of at least 800 kg/m$^3$ and a hardness (according to Janka) of at least 5000 N.

3. Floor element according to claim 1, wherein the transparent lacquer coating comprises a powder coating.

* * * * *